US006021565A

United States Patent [19]

Shinchi

[11] Patent Number: 6,021,565

[45] Date of Patent: Feb. 8, 2000

[54] WIRE CONNECTING STRUCTURE AND METHOD OF CONNECTING WIRE

[75] Inventor: Akira Shinchi, Shizuoka-ken, Japan

[73] Assignee: Yazaki Corporation, Tokyo, Japan

[21] Appl. No.: 09/003,363

[22] Filed: Jan. 6, 1998

[30] Foreign Application Priority Data

Jan. 9, 1997 [JP] Japan ..... 9-002332

[51] Int. Cl.[7] ..... H01R 43/04

[52] U.S. Cl. ..... 29/861; 29/749; 29/753; 29/861; 29/866; 29/867

[58] Field of Search ..... 29/749, 753, 861, 29/866, 867, 33 M

[56] References Cited

U.S. PATENT DOCUMENTS

| | | | |
|---|---|---|---|
| 4,486,950 | 12/1984 | Weidler | 29/866 |
| 4,653,825 | 3/1987 | Olsson | 339/48 |
| 5,109,602 | 5/1992 | Fukuda et al. | 29/845 |
| 5,115,562 | 5/1992 | Bowen et al. | 29/867 |
| 5,153,988 | 10/1992 | Mattis et al. | 29/863 |
| 5,327,644 | 7/1994 | Tanaka et al. | 29/861 |

FOREIGN PATENT DOCUMENTS

| | | |
|---|---|---|
| 4-162386 | 6/1992 | Japan . |
| 5-29056 | 2/1993 | Japan . |
| 7-70345 | 7/1995 | Japan . |

*Primary Examiner*—Lee Young
*Assistant Examiner*—Binh-An Nguyen
*Attorney, Agent, or Firm*—Finnegan, Henderson, Farabow, Garrett & Dunner, L.L.P.

[57] ABSTRACT

A wire connecting structure for connecting covered wires to terminals is provided. The wire connecting structure includes a connector housing body having grooves and a cover body having projections for engagement with the grooves. In arrangement, the terminals are accommodated in the grooves and the covered wires are disposed on the terminals, respectively. The connector housing body has engagement projections formed on opposing sidewalls, while the cover body has engagement holes formed on opposing sidewalls, for engagement with the engagement projections. Owing to the provision of the engagement projections and holes, the connector housing body is detachably united with the cover body on condition that the wires are electrically connected with the terminals. Therefore, it is possible for an operator to dissolve the structure and watch the inside even after the connecting structure is completed.

12 Claims, 4 Drawing Sheets

WIRE CONNECTING STRUCTURE AND METHOD OF CONNECTING WIRE

BACKGROUND OF THE INVENTION

The present invention relates to a wire connecting structure and a method of connecting a terminal with a covered wire having core lines covered with an insulating cover, the wire connecting structure being obtained by mounting the covered wire on the terminal and sequentially fusing the insulating cover by ultrasonic energy under pressure, thereby electrically connecting the terminal with the core lines of the wire.

Japanese Unexamined Patent Publication (Kokai) No. 7-70345 discloses a conventional connecting structure where a covered wire and a terminal are interposed between a first member and a second member. Both of the first and second members are made of plastic materials which are soluble in each other by ultrasonic oscillation.

In this connecting structure, the first member is provided with a plurality of grooves, while the second member is provided with a plurality of projections for respective engagement with the grooves. In order to connect the terminal with the covered wire, the terminal is firstly accommodated in one of the grooves and the wire is mounted on a wire mounting surface of the terminal in succession. Then, the second member is laid on the first member so that the projections engage in the grooves, respectively. Next, under such a condition, the first and second members are vibrated by the ultrasonic waves while exerting a pressure on both members. Consequently, owing to this ultrasonic oscillation, the insulating cover is fused, so that the exposed core lines come into electrical contact with the terminal.

While, in the above-mentioned connecting structure, the first member is welded to the second member by the ultrasonic oscillation, simultaneously. Therefore, even if a poor connection between the terminal and the wire is caused, it is impossible for an operator to ascertain a situation of the poor connection while opening the structure. Further, such an integrated connecting structure does not allow the operator to separate both members from each other, exchange the terminal for another one, reconnect the terminal with the wire again and so on.

SUMMARY OF THE INVENTION

It is therefore an object of the present invention to provide a wire connecting structure and a method of connecting a covered wire with a terminal, both of which allow the operator to open the connecting structure even after it has been completed.

The object of the present invention described above can be accomplished by a wire connecting structure for connecting a covered wire to a terminal, the wire connecting structure comprising:

- a first member having a groove formed for accommodating the terminal therein;
- a second member having a projection formed for engagement with the groove;
- the terminal accommodated in the groove of the first member; and
- the covered wire disposed on the terminal, the covered wire having core lines covered with an insulating cover;
- wherein the first member is detachably united with the second member through locking means;
- whereby the core lines are electrically connected with the terminal since the insulating cover is molten by vibrating the second member on the covered wire by ultrasonic waves while pressing the covered wire through the second member.

According to the above-mentioned wire connecting structure, since the first member is detachably united with the second member, it is possible for an operator to dissolve the structure and watch the inside, if required. Further, it is also possible to exchange the terminal for another one. Normally, since the first member is united with the second member through the locking means, it is possible for the operator to handle the structure as an integrated component.

In the present invention, preferably, the locking means comprises engagement projections which are formed on either one of the first and second members and engagement holes which are formed on the other of the first and second members for engagement with the engagement projections.

In this case, owing to the provision of the engagement projections and the engagement holes, it is possible for the operator to separate the first and second members from each other easily.

In the above case, more preferably, the engagement projections are formed on opposing sidewalls of either one of the first and second members and the engagement holes are formed in opposing sidewalls of the other of the first and second members.

In this case, it is expected that, owing to the position of the engagement projections and holes, the first member can be united with the second member stably under its stable condition.

Further, it is preferable that the other of said first and second members is provided, adjacent the engagement holes, with respective notches for guiding the engagement projections approaching the engagement holes.

In this case, it would be facilitated to engage the engagement projections with the engagement holes.

According to the present invention, the above object of the invention can be also accomplished by a wire connecting method of connecting a covered wire to a terminal between a first member having a groove and a second member having a projection, the covered wire having core lines covered with an insulating cover, the wire connecting method comprising the steps of:

- accommodating the terminal in the groove of the first member;
- mounting the covered wire on the terminal;
- laying the second member on the first member so that the projection enters in the groove;
- vibrating the second member on the covered wire by ultrasonic waves while pressing the covered wire through the second member, thereby melting the insulating cover while maintaining a condition that the first member is not welded to the second member; and thereafter,
- detachably uniting the first member with the second member through locking means while the core lines are electrically connected with the terminal.

According to the above-mentioned method, since the first member is not welded to the second member at the time of the ultrasonic oscillation, it is possible to separate both members from each other, if required.

Also in the above-mentioned method, it is preferable that the locking means comprises engagement projections formed on either one of the first and second members and engagement holes formed on the other of the first and second members for engagement with the engagement projections.

Similarly, it is more preferable that the projections are formed on opposing sidewalls of either one of the first and second members and the engagement holes are formed in opposing sidewalls of the other of the first and second members.

Further, preferably, the locking means can be brought into its locked condition that the first member is united with the second member, by depressing the second member against the first member by means of an ultrasonic horn.

In this case, due to the ultrasonic horn, it is possible to lock the second member on the first member just after the ultrasonic oscillation.

These and other objects and features of the present invention will become more fully apparent from the following description and appended claims taken in conjunction with the accompany drawing.

DESCRIPTION OF THE PREFERRED EMBODIMENT

Embodiments of the present invention will be described with reference to the drawings.

Figure 1:
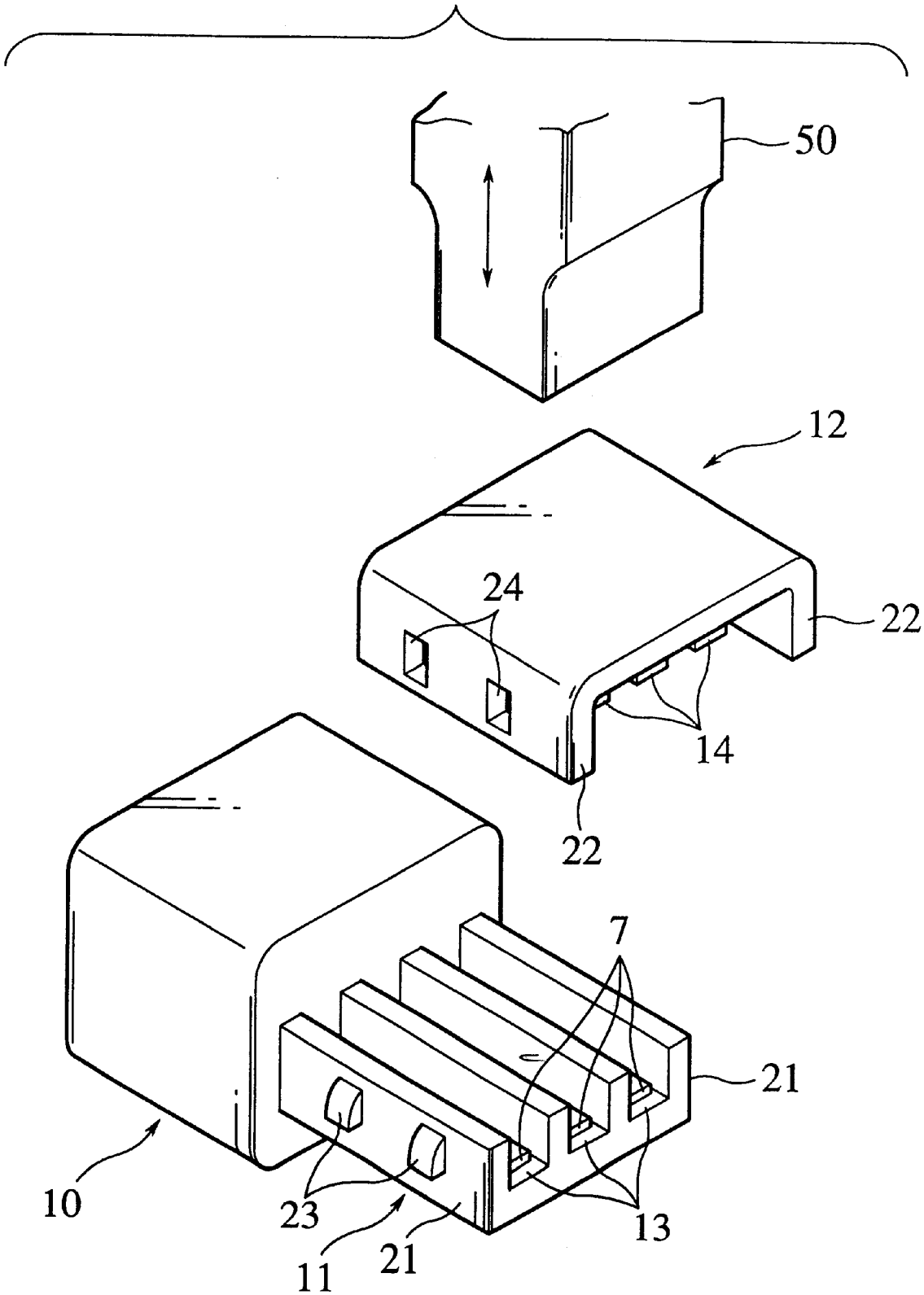
FIG. 1 is an explanatory perspective view of a wire connecting structure in accordance with an embodiment of the present invention, showing a relationship between a connector housing body and a cover body.
Figure 2:
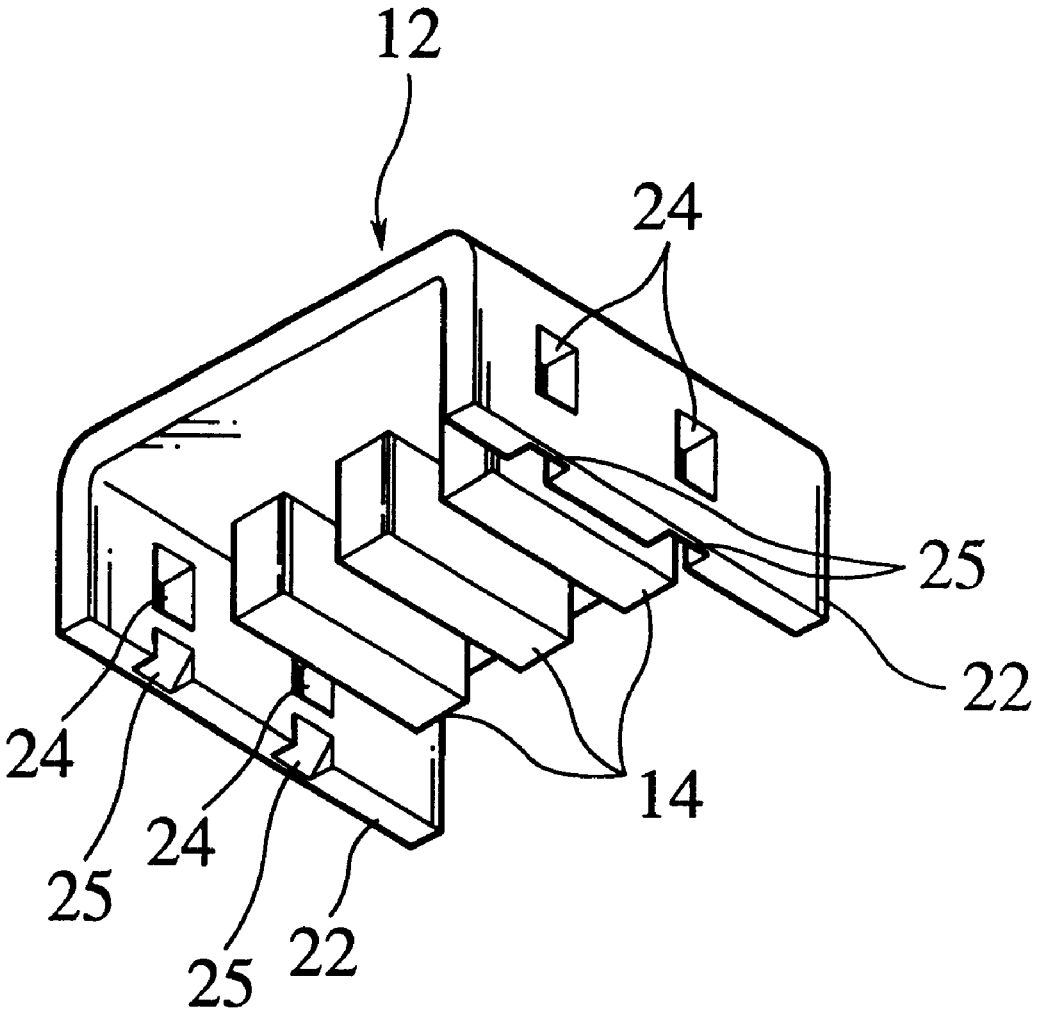
FIG. 2 is a perspective view of the cover body of the embodiment, viewed from an underside thereof.
Figure 3:
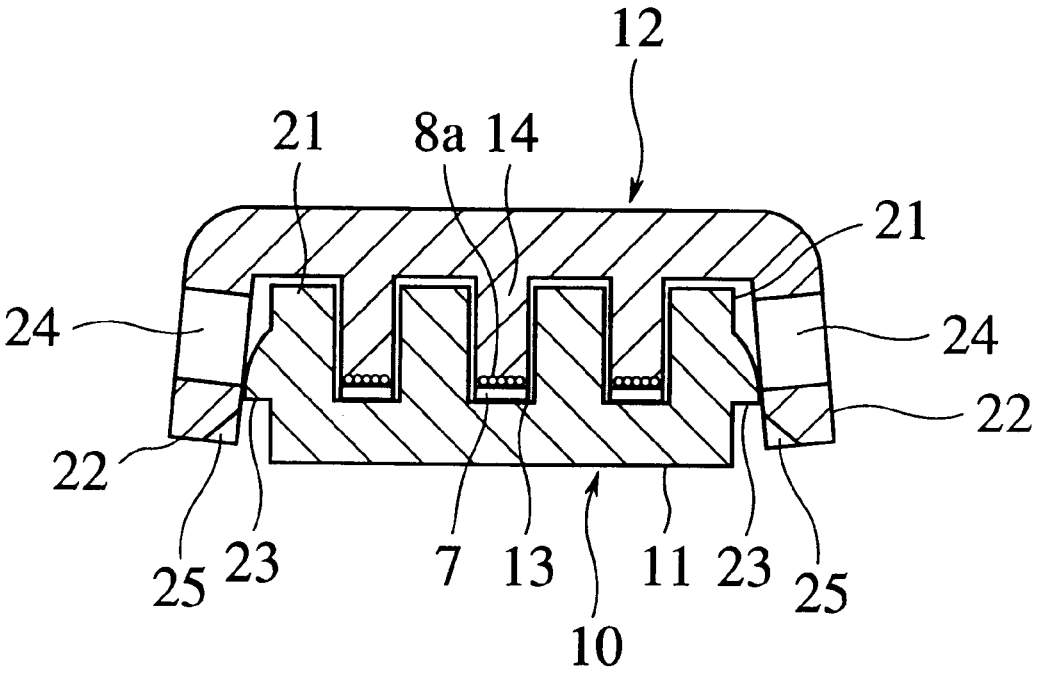
FIG. 3 is a cross sectional view of an essential part of the wire connecting structure of the embodiment, showing its prelocked state.

FIG. 1 shows a connector housing body 10 as a first member and a cover body 12 as a second member, constituting the wire connecting structure of the embodiment. FIG. 2 shows an inside of the cover body 12, viewed from the underside of the body 12.

The connector housing body 10 has a terminal retainer 11 formed so as to project from a rear end of the body 10. Strictly speaking, this terminal retainer 11 substantially corresponds to the first member of the wire connecting structure of the embodiment. Terminal retainer 11 is provided with a plurality of grooves 13. While, the cover body 12 is provided with a plurality of projections 14 for engagement with the grooves 13.

Both of the connector housing body 10 and the cover body 12 are made of resinous material. However, in order to avoid the mutual welding by ultrasonic waves, the bodies 10, 12 are constructed in a manner that the ultrasonic energy would not concentrate in contacts between the connector housing body 10 and the cover body 12 even when both bodies 10, 12 are fitted to each other.

As locking means allowing the connector housing body 10 to be combined with the cover body 12 instead of the ultrasonic welding, engagement projections 23 are formed on opposing sidewalls 21 of the terminal retainer 11, while engagement holes 24 for engagement with the projections 23 are formed in opposing sidewalls 22 of the cover body 12. Further, the cover body 12 is provided, under the engagement holes 24, with notches 25 for guiding the engagement projections 23 entering into the cover body 12 smooth, as shown in FIG. 2.

In order to complete a connector, a plurality of terminals 7 are firstly accommodated in the grooves 13 formed in the terminal retainer 11 of the connector housing body 10 and successively, a plurality of covered wires are mounted on the terminals 7. Then, the cover body 12 is overlaid on the connector housing body 10 while the projections 14 are inserted into the grooves 13 of the terminal retainer 11, respectively. In this state, an appropriate clearance is ensured between the cover body 12 and the terminal retainer 11 (e.g. between a top surface of the terminal retainer 11 and a lower surface of the cover body 12) for avoiding the mutual contact therebetween. Thus, the clearance accounts for preventing the ultrasonic welding of the cover body 12 to the terminal retainer 11.

Under such a condition, the ultrasonic oscillation, i.e. vertical vibrations by the ultrasonic waves, is applied on the cover body 12 by an ultrasonic horn 50 while applying pressure on the body 12 simultaneously. Consequently, the ultrasonic energy concentrates in the projections 14 interposing the covered wires together with the bottom surfaces of the grooves 13, so that respective insulating covers of the wires are molten to expose core lines 8*a* for electrical contact with the terminals 7.

Figure 4:
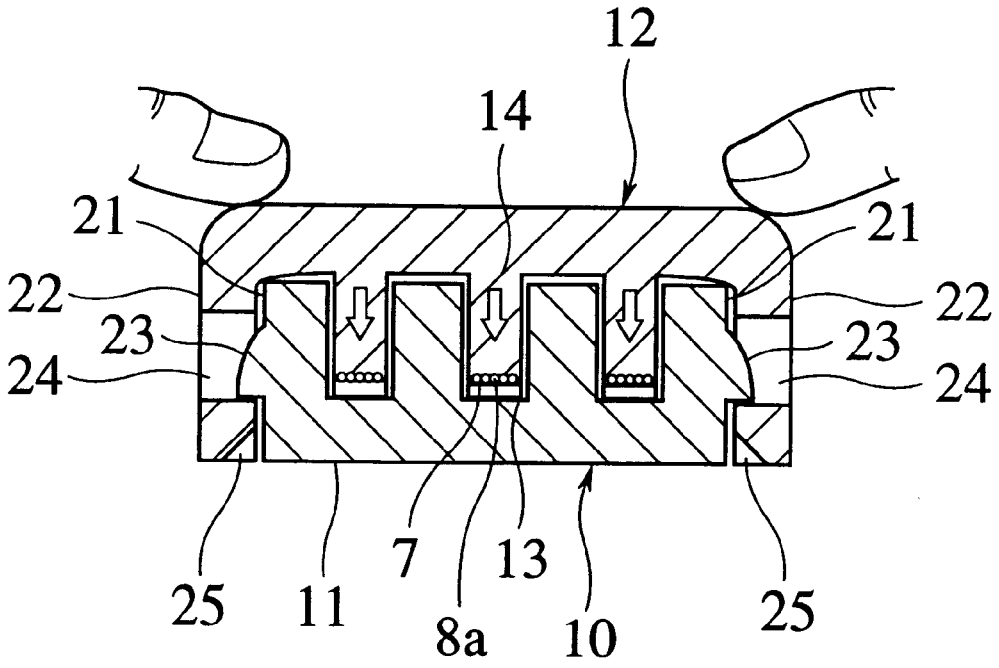
FIG. 4 is a cross sectional view of the essential part of the wire connecting structure of the embodiment, showing its locked state.

Thereafter, the ultrasonic oscillation by the ultrasonic horn 50 is suspended and the horn 50 is then lowered as it is. Consequently, the engagement holes 24 of the cover body 12 fit with the engagement projections 23 of the terminal retainer 11, respectively, so that the connector housing body 10 and the cover body 12 are united to complete the connector. Note, in a modified method, the connector housing body 10 may be locked to the cover body 12 by an operator's depressing both ends of the body 12 with his fingers, as shown in FIG. 4.

Under such a completed condition of the connecting structure, when it is necessary to detach the cover body 12 for some reason or other, the operator only has to expand the sidewalls 22 of the cover body 12 outside to disengage the engagement projections 23 from the engagement holes 24. In such a case, since the cover body 12 is not welded to the connector housing body 10, it is possible to detach the cover body 12 from the connector housing body 10 with ease. Accordingly, the detaching of the cover body 12 from the body 10 allows the operator to examine the connecting situation between the core lines 8*a* and the terminals 7 and exchange the terminals 7 for others.

Figure 5:
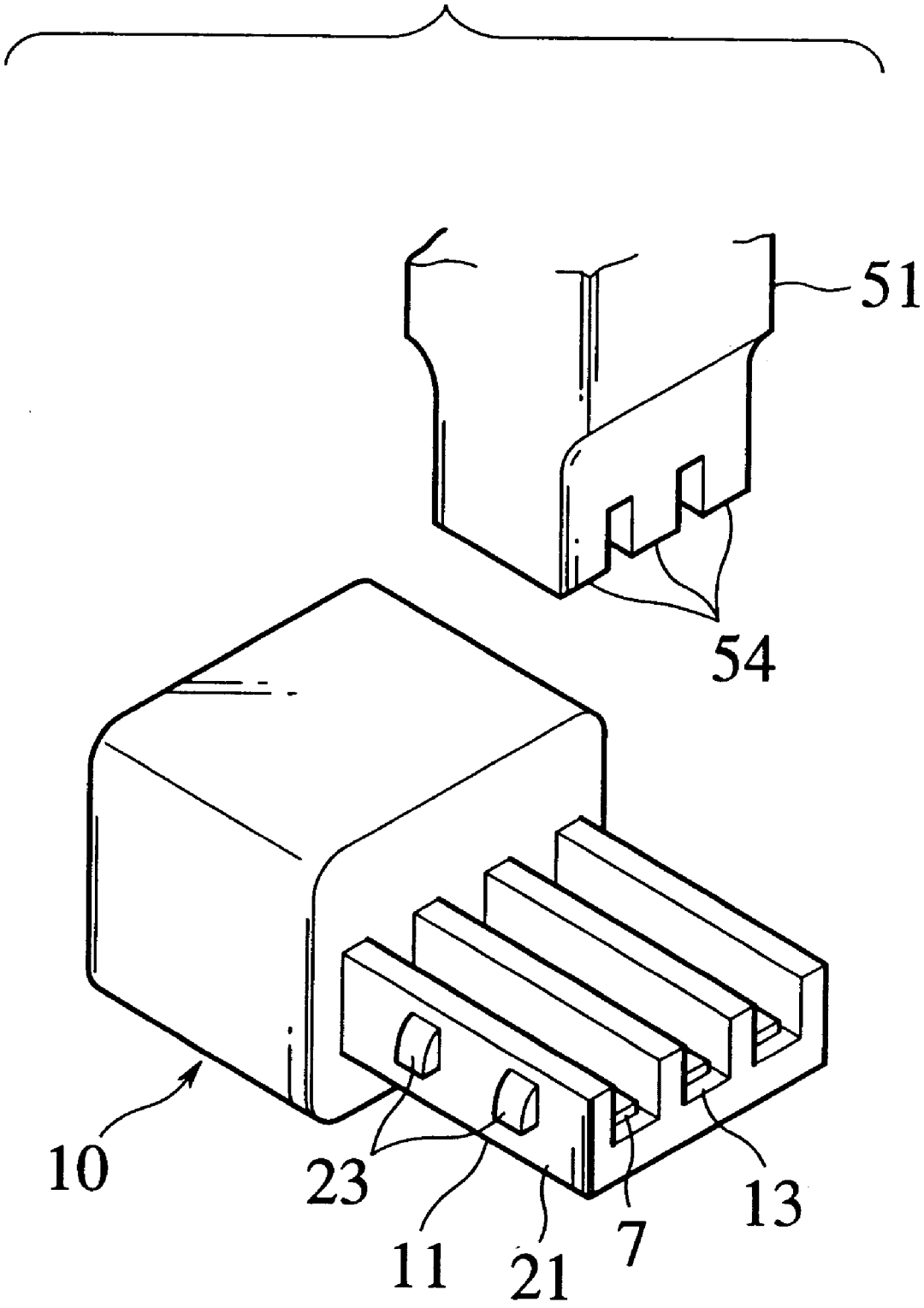
FIG. 5 is an explanatory perspective view of a wire connecting structure in accordance with another embodiment of the present invention.

Although the above-mentioned embodiment relates to the case of connecting the covered wires with the terminals through the cover body 12 by the ultrasonic oscillation, as shown in FIG. 5, the insulating covers of the wires may be directly molten by an ultrasonic horn 51 which is provided, on a lower end thereof, with projections 54 for engagement with the grooves 13 in a modification.

Finally, it will be understood by those skilled in the art that the foregoing descriptions relate to two embodiments of the disclosed wire connecting structure, and that various changes and modifications may be made to the present invention without departing from the spirit and scope thereof.

What is claimed is:

1. A wire connecting structure for connecting a covered wire to a terminal, said wire connecting structure comprising:

a first member having a groove formed therein, said terminal being accommodated in said groove;

a second member having a projection formed thereon for engagement with said groove; and wherein said covered wire is disposed on said terminal and has core lines covered with an insulating cover, and a vibration source electrically connects said core lines to said terminal without connecting said first member to said second member, and wherein locking means detachably unite said first member with said second member.

2. A wire connecting structure as claimed in claim 1, wherein said locking means comprises engagement projections formed on either one of said first and second members and engagement holes formed on the other of said first and second members for engagement with said engagement projections.

3. A wire connecting structure as claimed in claim 2, wherein said engagement projections are formed on opposing sidewalls of either one of said first and second members and said engagement holes are formed in opposing sidewalls of the other of said first and second members.

4. A wire connecting structure as claimed in claim 3, wherein the other of said first and second members is provided, adjacent said engagement holes, with respective notches for guiding said engagement projections approaching said engagement holes.

5. A method of connecting a covered wire to a terminal, said covered wire having core lines covered with an insulating cover, said wire connecting method comprising the steps of:

accomodating said terminal in a groove of a first member;

mounting said covered wire on said terminal;

laying a second member on said first member so that a projection of said second member enters said groove;

vibrating said second member on said covered wire by ultrasonic waves while pressing said covered wire with said second member, thereby melting said insulating cover while maintaining a condition that said first member is not welded to said second member; and detachably uniting said first member with said second member through locking means when said core lines are electrically connected with said terminal.

6. A wire connecting method as claimed in claim 5, wherein said locking means comprises engagement projections formed on either one of said first and second members and engagement holes formed on the other of said first and second members for engagement with said engagement projections.

7. A wire connecting method as claimed in claim 6, wherein said engagement projections are formed on opposing sidewalls of either one of said first and second members and said engagement holes are formed in opposing sidewalls of the other of said first and second members.

8. A wire connecting method as claimed in claim 5, wherein said first member is united with said second member by pressing said second member onto said first member.

9. A wire connecting structure comprising:

a first member having a groove;

a second member having a projection formed for engagement with said groove, said first member and said second member being vibrated by ultrasonic waves;

a terminal accommodated in said groove of said first member;

a covered wire placed on said terminal, said covered wire and said terminal being pinched between said groove of said first member and said projection of said second member, said covered wire having core lines covered with an insulation cover, said core lines being electrically connected to said terminal when ultrasonic waves are applied to said first member and said second member while pressing said covered wire between said projection and said groove so that said insulation cover is molten; and locking means detachably uniting said first member with said second member.

10. A wire connecting structure as claimed in claim 9, wherein said locking means comprises engagement projections formed on either one of said first and second members and engagement holes formed on the other of said first and second members for engagement with said engagement projections.

11. A wire connecting structure as claimed in claim 10, wherein said engagement projections are formed on opposing sidewalls of either one of said first and second member and said engagement holes are formed in opposing side walls of the other of said first and second members.

12. A wire connecting structure as claimed in claim 11, wherein the other of said first and second members is provided with respective notches, integral with and located substantially right under said engagement holes, for guiding said engagement projections into said engagement holes.

* * * * *

UNITED STATES PATENT AND TRADEMARK OFFICE

CERTIFICATE OF CORRECTION

PATENT NO. : 6,021,565
DATED : February 8, 2000
INVENTOR(S) : Shinchi

It is certified that error appears in the above-identified patent and that said Letters Patent is hereby corrected as shown below:

Claim 11, Column 6,
Line 37, "member" should read -- members --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*